US007380792B2

(12) United States Patent
Taranino

(10) Patent No.: US 7,380,792 B2
(45) Date of Patent: Jun. 3, 2008

(54) WAGER-BASED DOMINO GAMES

(75) Inventor: Elia Rocco Taranino, Las Vegas, NV (US)

(73) Assignee: Caribbean Cage, LLC, San Juan, PR (US)

( * ) Notice: Subject to any disclaimer, the term of this patent is extended or adjusted under 35 U.S.C. 154(b) by 108 days.

(21) Appl. No.: 11/443,888

(22) Filed: May 31, 2006

(65) Prior Publication Data

US 2007/0278738 A1 Dec. 6, 2007

(51) Int. Cl.
*A63F 9/04* (2006.01)

(52) U.S. Cl. ..... 273/146

(58) Field of Classification Search ..... 273/146
See application file for complete search history.

(56) References Cited

U.S. PATENT DOCUMENTS 4,004,812 A 1/1977 Lutz
4,125,263 A 11/1978 Hamilton
4,359,227 A 11/1982 Porciello
4,530,499 A * 7/1985 Breslow et al. ..... 463/9
4,804,185 A * 2/1989 Noble et al. ..... 463/11
5,122,087 A 6/1992 Coccoli et al.
5,791,652 A 8/1998 Nielsen
5,938,528 A * 8/1999 Glapion ..... 463/11
6,893,020 B1 5/2005 Snyder
6,942,218 B2 9/2005 Davis et al.
2003/0073475 A1* 4/2003 Friedman ..... 463/11
2006/0119038 A1* 6/2006 Crotteau ..... 273/148 R
2008/0018049 A1* 1/2008 Hebden ..... 273/292

FOREIGN PATENT DOCUMENTS

GB 2191953 A * 12/1987

* cited by examiner

*Primary Examiner*—Gene Kim
(74) *Attorney, Agent, or Firm*—Weide & Miller, Ltd.

(57) ABSTRACT

A wager-based domino game is suited for individual play, particularly as presented at a gaming machine. In accordance with the game, a player attempts to play one or more dominos. Various outcomes of game play are defined as losing. A number of outcomes are defined as winning and have associated awards, such as defined by a paytable. In one embodiment, winning outcomes may be awarded in the event a minimum number of dominos are played, or based upon a summed value of all dominos played. Domino-based bonus events offer a player additional winnings. The bonus events may be triggered by particular events of the wager-based domino game.

12 Claims, 6 Drawing Sheets

WAGER-BASED DOMINO GAMES

FIELD OF THE INVENTION

The present invention relates to methods and apparatus for playing games.

BACKGROUND OF THE INVENTION

Domino games are very popular in various regions of the world. Domino games are particularly popular in the Caribbean and South and Central American countries.

Generally, domino games are played with a set of dominos. Each domino is a tile (generally a rectangular member) marked on one side with markings which represent value. Each domino has a pair or markings or two values. Generally, these marking comprise pips (usually circular dots).

The number of dominos used in a particular game may vary. For example, a set of dominos may comprise a collection of dominos marked with values 0-0 through 6-6. Each domino of the set is unique in that no other domino is marked with the same two values. The set of dominos comprises all combinations of potential values from the minimum to the maximum. Thus, in the set of dominos including the values 0-0 to 6-6, the set will include 28 dominos marked with the following values: 0-0, 0-1, 0-2, 0-3, 0-4, 0-5, 0-6, 1-1, 1-2, 1-3, 1-4, 1-5, 1-6, 2-2, 2-3, 2-4, 2-5, 2-6, 3-3, 3-4, 3-5, 3-6, 4-4, 4-5, 4-6, 5-5, 5-6 and 6-6. In other games, the set of dominos may include dominos marked with values up to 8-8 or even 12-12.

Currently, known dominos games are all multi-player games. Most games involve two to four players, though some games may accommodate more players. Some of these games include Chickie, Matador, Muggins, Texas 42 and others.

SUMMARY OF THE INVENTION

The invention comprises various domino games and events, including methods of playing and presenting domino games.

In one embodiment, a domino game is configured as a single-player wagering game. The player attempts to play one or more dominos against a paytable of winning outcomes for an opportunity for an award.

In accordance with one domino game, a player places, and a wager which is accepted by the house. A first domino is selected from a set of dominos, and that domino is displayed to the player. Preferably, one or more additional dominos are selected and it is determined if these dominos match the first domino or other earlier matching dominos. A player is awarded winnings in accordance with a paytable which provides for awards based upon a number of matching dominos or a point total of matching dominos.

In one embodiment, each domino which is selected but which does not match is considered unplayable and is set aside, such as in a "grave yard". If an unplayable domino becomes playable, then it is played. The game ends when either all dominos of the set are played or a predetermined dominos are unplayable (such as three dominos in the grave yard).

The game may be played as a table game using physical dominos, or as a table or machine-based game in which images or representations of the dominos are displayed to the player. When presented at a machine, a set of video simulated dominos may be displayed face-down. Each selected domino may be revealed for play. At the end of the game, all remaining dominos may be turned over for viewing by the player.

The invention includes dominos-based bonus events. The bonus events may be associated with a domino game or other types of games. In accordance with one bonus event, a player domino is compared to a dealer domino and the outcome of the event is declared a winning event if the value of the player domino is greater than that of the dealer domino. In one embodiment, a winning outcome entitles the player to double their then-existing winnings for the game. This bonus event may be triggered when a player successfully plays certain numbers of dominos.

In accordance with another bonus event, the values of two dice are compared to a set of dominos. If the values of the dice match one of the dominos, that domino is removed. A player attempts to remove as many dominos from the set as possible before a predetermined number of dice values do not match. In one embodiment, this bonus event is triggered when a player receives a certain domino and/or plays a certain number of dominos after receiving a particular domino.

Further objects, features, and advantages of the present invention over the prior art will become apparent from the detailed description of the drawings which follows, when considered with the attached figures.

DETAILED DESCRIPTION OF THE INVENTION

Figure 1:
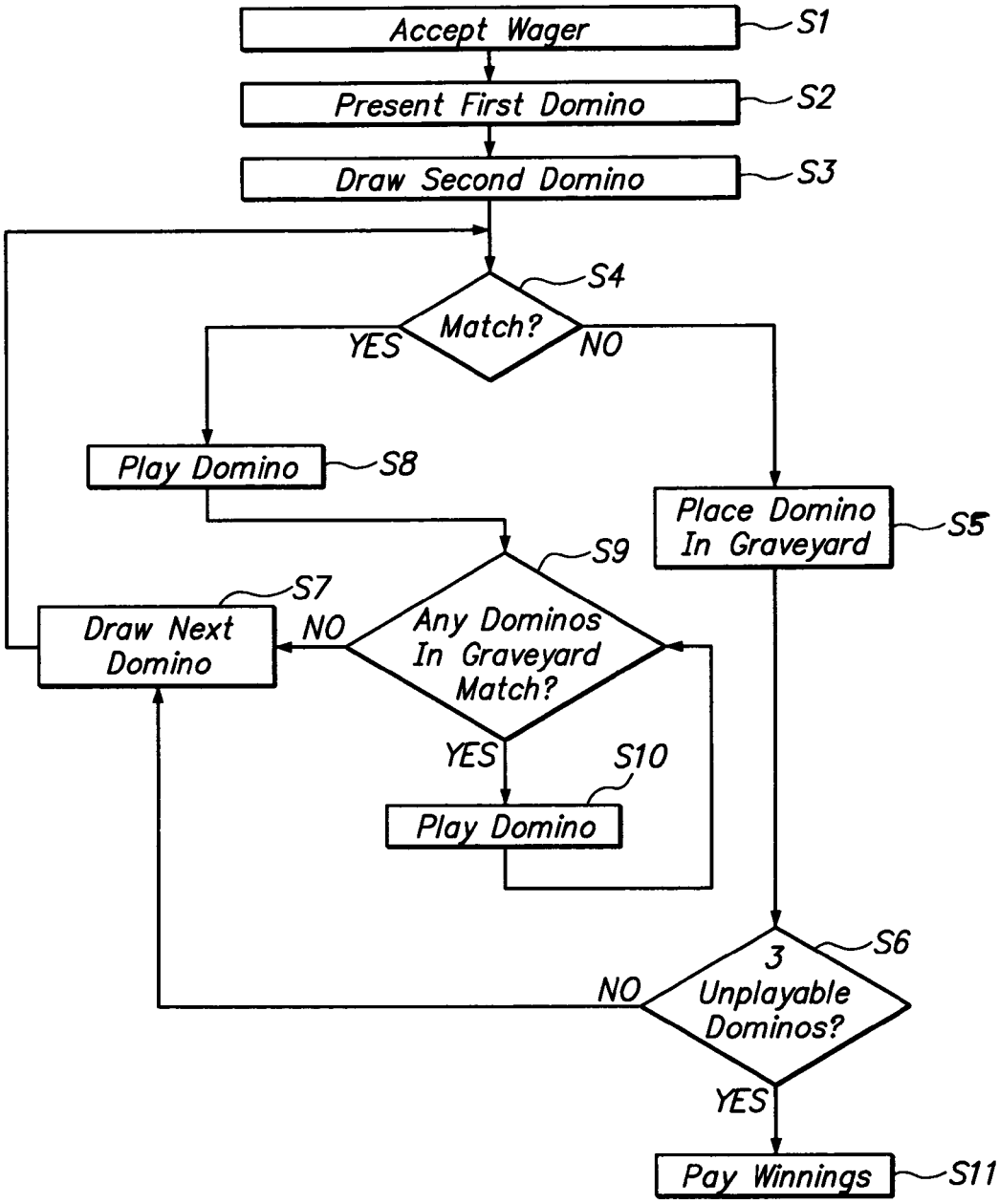
FIG. 1 is a flow diagram of a domino game in accordance with an embodiment of the invention.

The invention comprises methods of playing domino games and apparatus and/or systems for presenting such games. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the invention comprises methods of presenting and playing one or more domino games. Preferably, the domino games are wagering games which are suited for play by a single player. In one or more embodiments, a player plays for winning outcomes entitling the player to an award of winnings. Preferably, the methods of game play are suited to presentation at one or more electronic or electromechanical gaming machines.

One or more of the games of the invention utilize dominos, as are well known in the art. In general, as indicated above, dominos may comprise objects bearing pips or other markings representing value. The dominos are generally rectangular in shape, having a pair of opposing sides and a pair of opposing ends. Each end has an associated value. The number of dominos used in a particular game may vary, such as up to the values 6-6, 9-9, 12-12 or the like. In accordance with the invention, the dominos may be graphically represented, such as by using images or renderings of the dominos. Alternatively, other indicia may be utilized to represent the dominos and their associated values.

One embodiment of a domino game in accordance with the invention will be described with reference to FIG. 1. Preferably, the game is played as a wager-based game. In a step S1, the player places a wager. The wager is accepted by a third party, such as the house or a banker. Preferably, the wager is of value, such as coins, credits or the like. The wager may be placed in various fashions. For example, when the game is presented at a gaming machine, the player may wager credits by pressing a "bet" button. Of course, the player might place a wager with coins, tokens/chips or the like.

In a step S2, at least one domino is presented. Preferably, a single domino is presented. In one embodiment, this may comprise dealing or distributing a physical domino. In a gaming machine environment, this preferably comprises displaying a graphical representation of a domino.

Preferably, the domino which is presented is randomly selected from a set of dominos. As indicated above, the size of the set may vary. In the case of a gaming machine, one or more random numbers may be generated. That number or numbers may be used to select the domino to be displayed. In a preferred embodiment, the player is permitted to select the domino from the set of dominos. For example, a player may be prompted to touch an area of a touch-sensitive graphical display or screen so as to select a domino.

In one embodiment, all or a number of dominos of the set which are to be used in the play of the game are displayed to a player. For example, referring to FIG. 2, all of the dominos 20 of the set of dominos to be used in the game may be displayed in a face-down position.

In one embodiment, the set of dominos which are used to play the game may be displayed in a "bone yard" area 22. Where the dominos 20 are graphically illustrated in a video display, the bone yard area 22 may simply comprise a portion or area of the display. Lines or other elements may be displayed to create a visual "separator". Of course, in table-game play, the dominos could simply be physically located in a particular area on the table.

Figure 2:
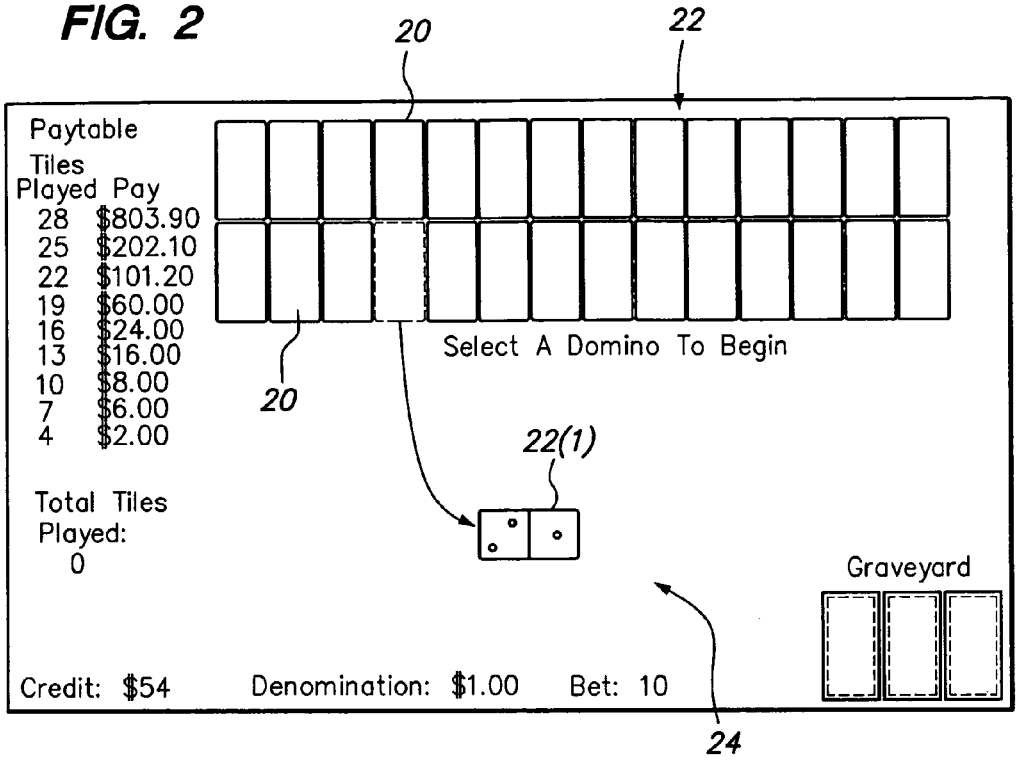
FIGS. 2-6 illustrates aspects of an example game played in accordance with the invention.

In this step, the first selected domino is preferably displayed face-up so that the pips or values are visible to the player. This domino comprises the "starting" point for the game. FIG. 2 illustrates one example wherein the first domino 22(1) has the value 1-2.

In a preferred embodiment, the dominos which are "played" are displayed in a "play area" 24. The play area 24 is preferably separate from the bone yard 22. Again, this area may simply comprise an area of a table or graphical display, which area might be set off visually from one or more other areas by visual indicators such as lines, colors or the like.

Preferably, the first domino is selected from the set of displayed dominos. In other embodiments, however, that domino could be selected from a set of dominos other than those which are displayed in the bone yard 22 (but there are preferably no duplicate dominos between the first displayed domino and any of the dominos otherwise to be used in play of the game).

Referring again to FIG. 1, in a step S3, a second domino is presented or displayed. Again, this domino is preferably selected from the set of displayed dominos. In a preferred embodiment, a player is permitted to select the second domino.

Figure 3:
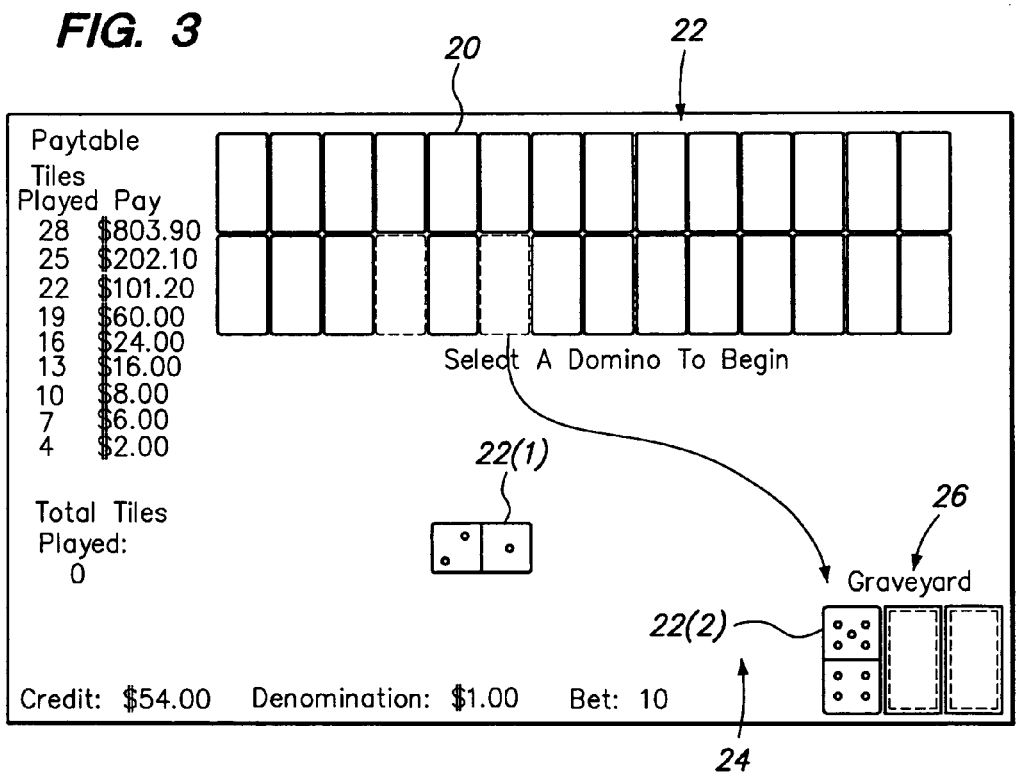

In a step S4, it is determined if this domino is "playable," meaning that it has at least one value which matches one of the values of the first domino. One example of this step will be described with reference to FIG. 3. As illustrated, the player has selected a second domino 22(2) from the set of dominos, and that domino has a value of 5-4. These values are compared to the values of the first domino (1-2, as illustrated in FIG. 3), and it is determined that the dominos can not be arranged in any configuration where their values match.

In one embodiment, if a domino is playable, the one or more positions at which the domino may be played may be highlighted or otherwise visually displayed to the player to aid the player in properly playing the domino. In this configuration, the player may be permitted to not only select a domino, but select the particular play position for that domino. As detailed below, preferably the dominos can only be played in an "end to end" configuration. In other embodiments, the dominos may be played to the side, particularly from dominos which are "doubles" (having the same value at each end).

With reference to FIG. 1, if the domino can not be played, then in a step S5, it is set aside. In one embodiment, the unplayable domino is placed in a segregated area, such as a "grave yard" area 26 (see FIG. 3). Again, this area may simply comprise an area of a table or graphical display, which area might be set off visually from one or more other areas by visual indicators such as lines, colors or the like.

Referring again to FIG. 1, in one embodiment of the game, the game ends when there are a predetermined number of dominos which have been selected but which can not be played. In one embodiment, in a step S6, once at least three dominos reside in the grave yard at a particular time, game play ends.

In the example provided, only one domino (the second domino 22(2)) is unplayable and is located in the grave yard. As such, in a step S7, a next domino is selected. Once again, this domino may automatically be selected, but is preferably player selected. The domino is preferably selected from the remaining dominos in the set of dominos (i.e. displayed in the bone yard). It is then determined, as in step S4, whether the domino is playable (i.e. matches).

Figure 4:
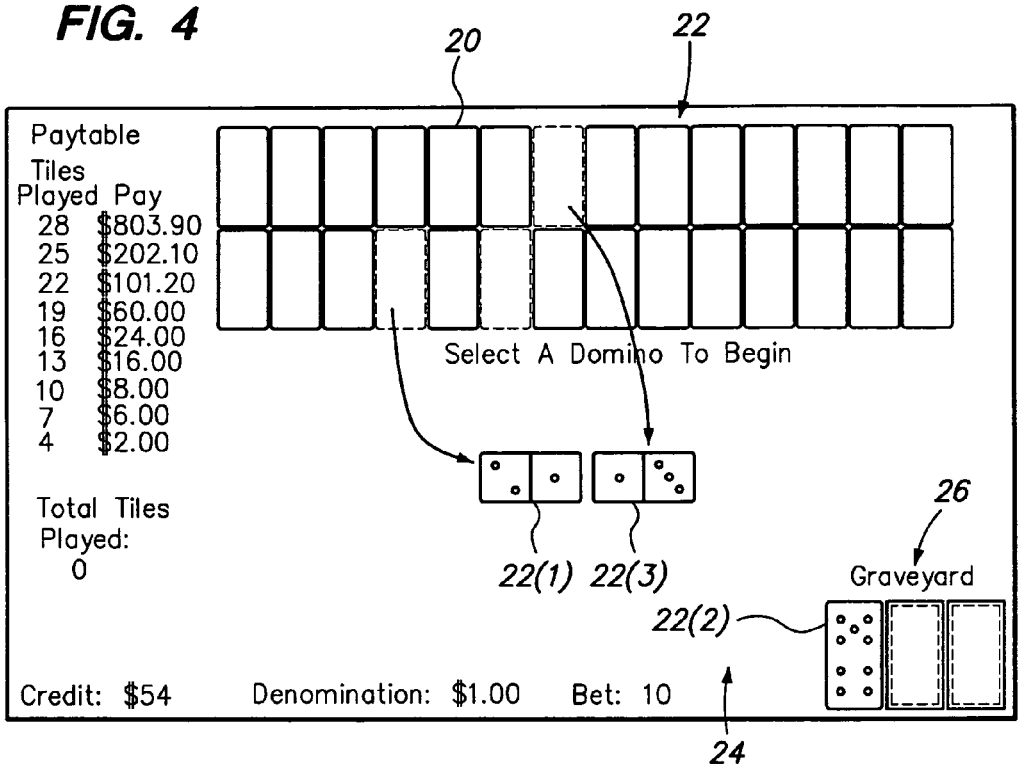

FIG. 4 illustrates one example of these steps. As illustrated, a player has selected a third domino 22(3). As illustrated, this domino 22(3) has a value 1-3. As such, this domino can be played, since one of its values (1) matches one of the values (1) of the first domino 22(1). As such, that domino can be played, as in step S8 in the flowchart illustrated in FIG. 1.

If a domino can be played, then in a step S9, it is preferably determined if any of the previously unplayable dominos (if any) can be played. For example, referring to FIG. 4, it would next be determined if the second domino 22(2) which was previously unplayable and placed in the grave yard, could be played. If so, then in a step S10, that domino is played and it is then determined if any other dominos which were previously unplayable (if any remain) can be played.

In a step S9, if no such dominos are playable, then the game returns to step S7, in which another domino is selected.

Figure 5:
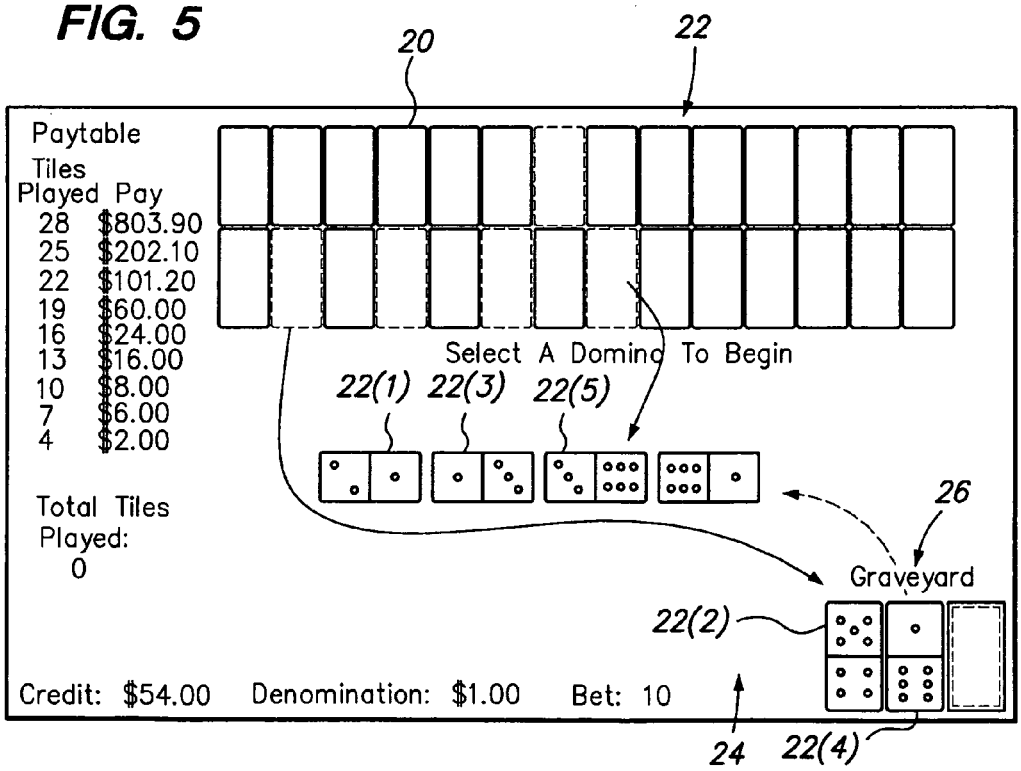

Various of these steps will be described with reference to FIG. 5. As illustrated therein, after the third domino 22(3) was played and the earlier selected second domino 22(2) was determined to be unplayable, the player selected a fourth domino 22(4) (as in step S7 of FIG. 1). This domino, having a value of 1-6 was unplayable, and was placed in the grave yard 26 along with the second domino 22(2). Since no domino was playable from the grave yard 26 and there were not yet three dominos in the grave yard, the player selected a fifth domino 22(5). This domino, having a value 3-6, was playable, and was thus placed in the play area 24.

At that point, it was determined (as in step S9 of FIG. 1), whether any dominos which were previously unplayable are now playable. It was determined that the fourth domino 22(4) was playable. It was thus moved from the grave yard 26 to the play area 24.

As indicated, in a preferred embodiment, in this example, play would continue until the player had played all dominos or three unplayable dominos were located in the grave yard. In this regard, though not illustrated in the flow diagram illustrated in FIG. 1, the method may include the step of determining if all dominos of the set have been played. If so, the game may automatically end.

Figure 6:
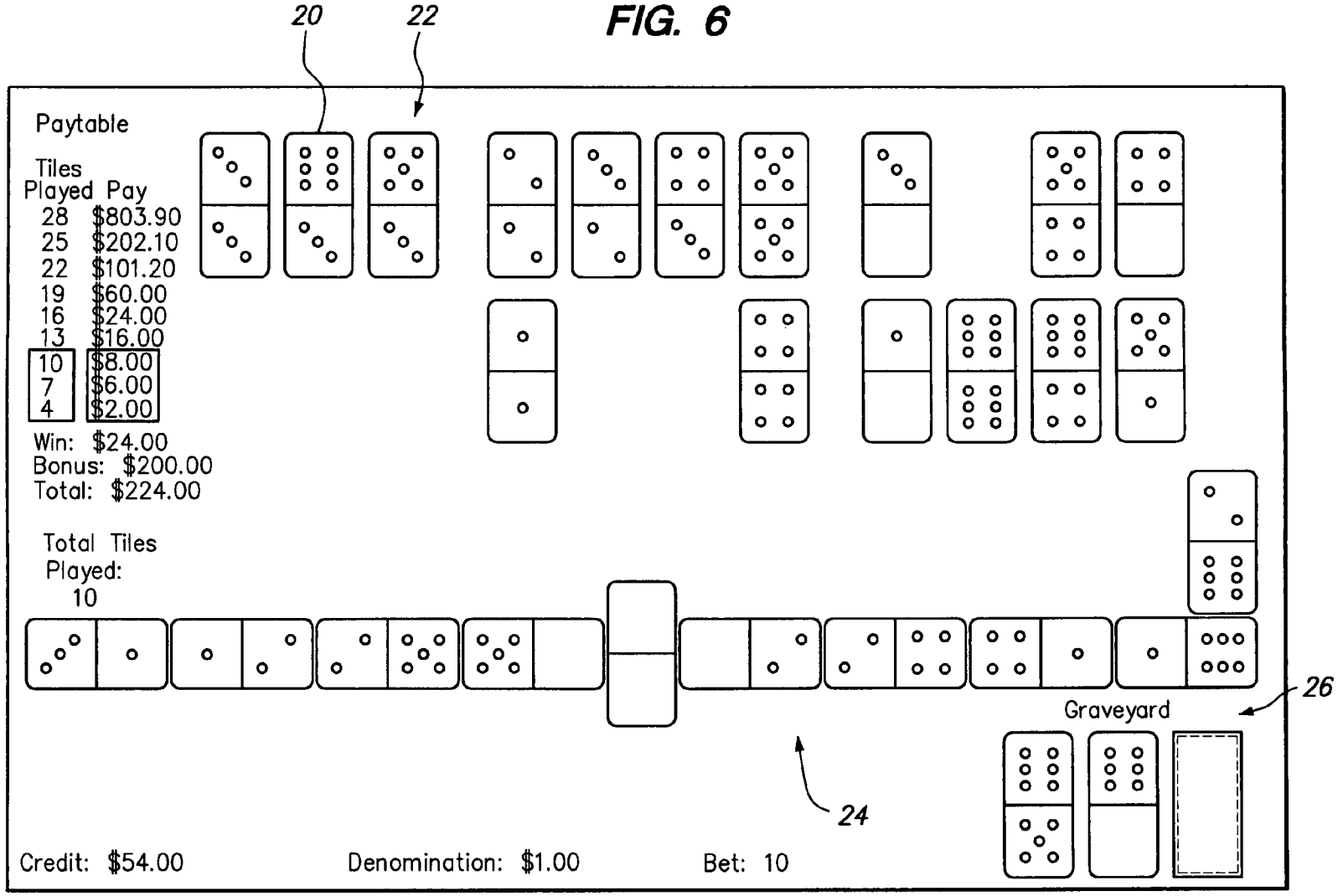

Referring to FIG. 6, in one embodiment, if all of the dominos are not played, the unselected dominos in the "bone yard" 22 may be turned over or turned face-up to reveal their values. In this manner, the player can confirm that all dominos were available for play and can determine the location of various of the dominos which could have been played.

In a preferred embodiment, the game is played with the opportunity for one or more awards. In one embodiment, the awards comprise value, such as money, prizes, credits (representative of value) or the like. As such, in a step S11 of the method, the player may be awarded winnings (if any).

A particular aspect of the invention is a method of playing a wager-based domino game with the opportunity to be awarded winnings. In one embodiment of the invention, a player may be awarded winnings dependent upon the number of dominos they are able to successfully play. One example of a paytable for such a game is set forth below.

TABLE 1

| Number of dominos played (of a 28 domino set) | Award (in credits based upon 1 credit wager) |
|---|---|
| 0-3 | 0 |
| 4-6 | 2 |
| 7-9 | 6 |
| 10-12 | 8 |
| 13-15 | 16 |
| 16-18 | 24 |
| 19-21 | 60 |
| 22-24 | 100+ |
| 25-27 | 200+ |
| 28 | 800+ |

In one embodiment, the awards may be fixed. In another, they may vary. For example, in reference to Table 1, the awards for the top three winning levels (22-24, 25-27 and 28 dominos) may be "progressive" awards which increase over time. These awards may increase based upon the number of games played, the wagers placed or other factors.

In another embodiment, a player may be awarded winnings dependent upon the "value" of the dominos which they are able to successfully play. This maybe determined by summing the value of the dominos (i.e. adding the pips). One example of a paytable for such game is set forth below.

TABLE 2

| Value of dominos played (from a 28 domino set) | Award (in credits based upon 1 credit wager) |
|---|---|
| 0-39 | 0 |
| 40-55 | 1 |
| 56-70 | 2 |
| 71-85 | 5 |

TABLE 2-continued

| Value of dominos played (from a 28 domino set) | Award (in credits based upon 1 credit wager) |
|---|---|
| 86-95 | 10 |
| 96-100 | 20 |
| 101-110 | 25 |
| 111-120 | 50 |
| 121-125 | 100 |
| 126-130 | 250 |
| 131-135 | 500 |
| 136-200 | 1000 |

In one embodiment, winnings may be awarded at the end of the game. In another embodiment, winnings may be awarded as a player reaches each pay level. For example, once a player has played 4 dominos (as in Table 1 above), the player may be awarded winnings. As soon as the player reaches 7 dominos, the player maybe awarded an additional winnings. Once awarded, these winnings belong to the player, even if the game ends without the player reaching a higher level. For example, if a player plays 7 dominos, they would be awarded 6 credits in accordance with Table 1. If the player was unable to play any more dominos, the player would keep the 6 awarded credits.

Of course, this aspect of the invention maybe applied to domino games played in accordance with other methods. Further, the method of domino play described above may vary and may have a number of other or additional features.

This aspect of the invention has particular advantages. In particular, while current domino games are multi-player games, the present invention provides for an exciting and entertaining single player domino game. Because the game can be presented in single player format, it is particularly suited to being presented via an electronically-controlled gaming machine. This allows the game to be presented in an exciting and controlled environment. This configuration does not require a "dealer" and allows a player to play the game alone. Further, the game offers the player the excitement of having a possibility of a monetary award.

In one embodiment, the size and timing of the wager or wagers which the player is required to place may vary. For example, a player may be required to place only a single wager at the beginning of the game. This wager could be a single credit or multiple credit wager. In one embodiment, the player might be required to "buy" additional dominos. For example, the player might be entitled to the first displayed domino and one additional "draw" domino. For the opportunity to play a third and each subsequent domino, the player might be required to place one or more additional wagers.

In one embodiment, the game might end when fewer or greater numbers of dominos can not be played. For example, the game might end as soon as a particular domino can not be played, or it might not end until four or more dominos can not be played.

In one embodiment of the game, in order to "match" one domino to another, a value at one end of a domino to be played must match the value of a free end of one of the already played dominos. In this configuration, the dominos can only be played "linearly." In another embodiment, the dominos might be played to the "side" as is known the art of domino game play. This aspect of play might be reserved to "double" dominos (i.e. dominos having duplicate values, like 2-2, 3-3 or the like). For example, if the first domino displayed as a value of 3-3, a player might be permitted to play dominos having matching a matching value of 3 at either end or from either side of that first domino. Obviously, this results in a greater number of potential play options.

The domino games of the invention may have a variety of other features. For example, the game or games may have one or more bonus opportunities. These bonus opportunities may be independent of particular outcomes of the main game, or may be dependent thereon. The bonus opportunities may offer the player additional winnings or awards.

Figure 7:
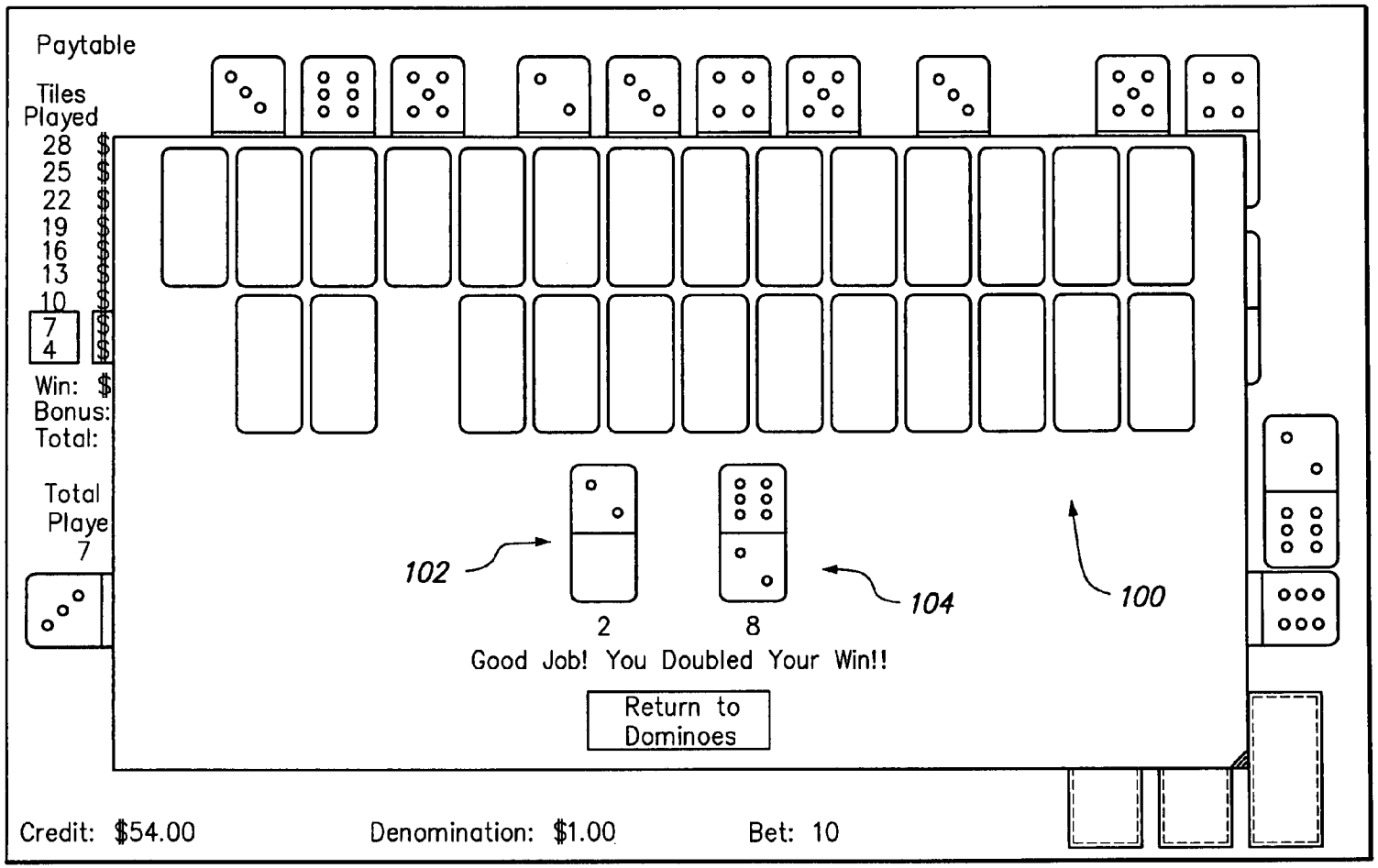
FIG. 7 illustrates a first bonus game in accordance with the invention.

One embodiment of a bonus game in accordance with the invention will be described with reference to FIG. 7. In one embodiment, the bonus game comprises comparison of a base or dealer domino to a player or game domino. As illustrated, all of the dominos 100 of a set of dominos may be displayed to a player (either actual dominos or video representations thereof). The base or dealer domino 102 may be automatically selected and displayed, or selected by a player and then displayed. A player or game domino 104 may then be selected and displayed, either automatically or, more preferably, by a player.

In one embodiment of the bonus game or event, the player is a winner if the player domino has a higher total value than the total value of the dealer domino. In the example illustrated, the dealer domino has a value of 2 (2+0) and the player domino has a value of 8 (6+2). As such, the outcome of the bonus event is a winning outcome to the player. In the event of a tie, the outcome may be declared winning or losing, as desired.

In one embodiment, if the outcome is a winning outcome, then the player is preferably awarded winnings. The bonus event may be played as a part of the previously described base domino game. For example, each time a player reaches an "award level" (such as reaching 4 played dominos, 7 played dominos or the like, as per Table 1 set forth above) the player may be provided the opportunity to play the bonus event. In one embodiment, the player is permitted the opportunity to double their current total winnings for the game in the event the outcome of the bonus event is a winning outcome. For example, if a player has received 2 credits by reaching the 4 dominos played level, the player may double those winnings to 4 credits. If the player reaches the 7 dominos played level, the player is awarded another 4 credits. If the player won the first bonus event, the player then has 8 total credits, and is given the opportunity to double those winnings.

It will be appreciated that the bonus game or event may be offered at other times or be triggered by other events. For example, a player's receipt of a particular domino or combination of dominos might trigger the bonus event. A total value of dominos played might also trigger the bonus event.

The bonus event might vary from that described above. For example, instead of comparing the total value of the dominos, the outcome might be winning only if the "top" value of the player domino is higher than the "top" value of the dealer domino (in the example in FIG. 7, the top value of the player domino is 6 and the top value of the dealer domino is 2), and if the "bottom" value of the player domino is higher than the "bottom" value of the dealer domino (in the example in FIG. 7, the bottom value of the player domino is 2 and the bottom value of the dealer domino is 0). In all other instances, the outcome might be losing.

It will also be appreciated that the bonus event might be played as a qualifying event to another game, as a bonus event to another game (such as a non-domino game or other domino game) or as an independent event. The event is referred to as a "bonus" event because in a preferred embodiment, the player is offered the opportunity to participate in the event as part of play of the main game and without having to place an additional wager. In other embodiments, however, it is possible that the player might be required to place a wager to play the event.

Figure 8:
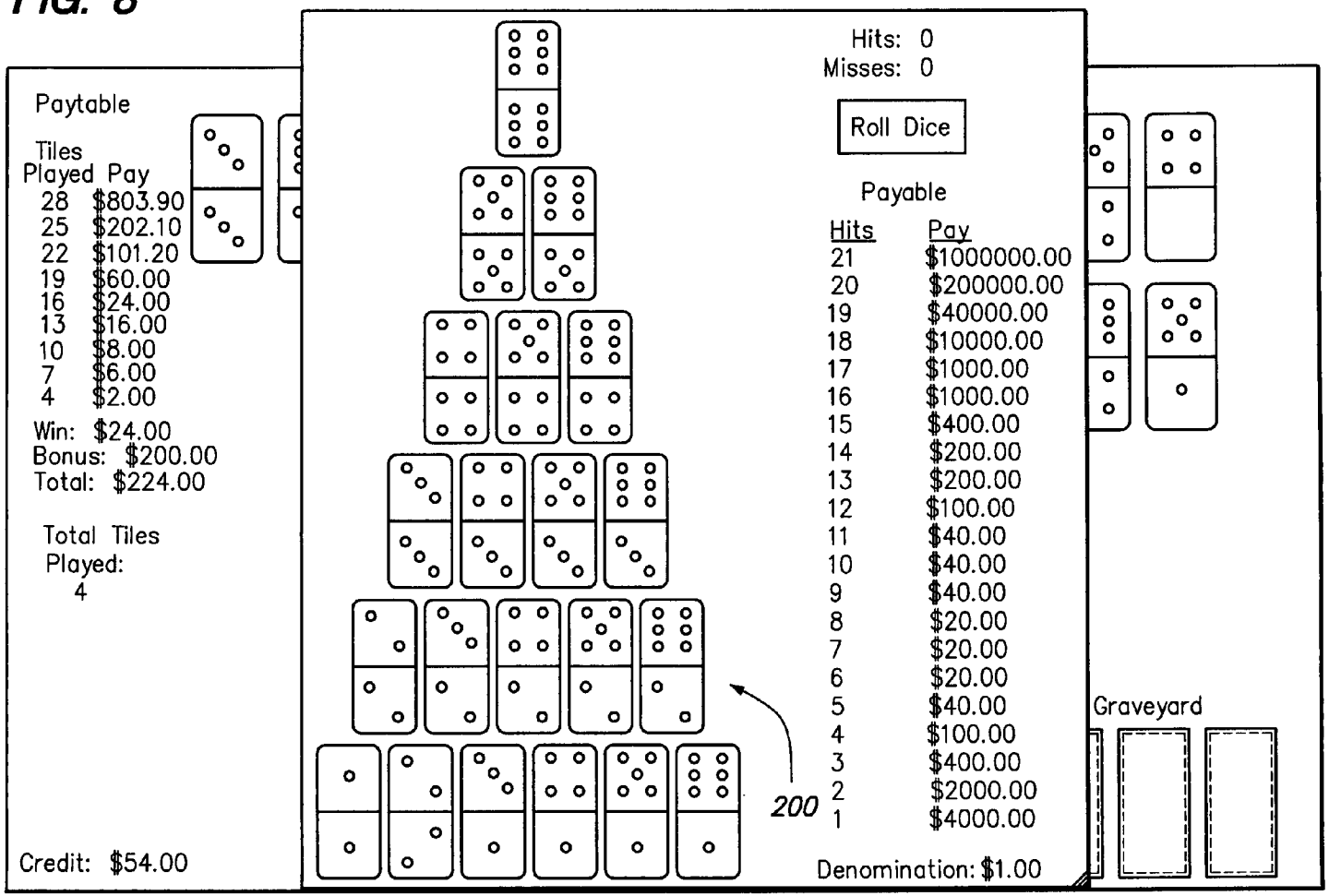
FIG. 8 illustrates a second bonus game in accordance with the invention.

Another embodiment of a bonus event will be described with reference to FIG. 8. As illustrated, a set of dominos 200 are displayed. In one embodiment, the dominos comprise a set which do not include any zero (0) value dominos, and which have a maximum value of 6. As illustrated, the dominos may be arranged into a pyramid.

A player is given the opportunity to roll a pair of dice. Each dice is preferably of the six-sided variety, each side labeled with a value of 1-6. The outcome of each roll of the dice is represented as a pair of values, such as 3-6. For each roll, the corresponding domino of that same value is removed from the displayed dominos. If the domino corresponding to a rolled dice value has already been removed, the roll is a "miss." Preferably, a player keeps rolling the dice and attempts to remove as many dominos as possible before the player receives three misses.

As illustrated, a player is preferably awarded winnings depending upon the number of dominos which are removed or hit. In the example paytable which is illustrated, a player is awarded winnings for all possible numbers of dominos which are removed or hit. In other instances, some numbers of removed or hit dominos might be "losing" or otherwise have an award value of zero (0).

As illustrated, a player attempts to remove all of the dominos before the player receives three misses.

In one embodiment, this bonus event is triggered by one or more events of a base game, such as the domino game described above. For example, relative to that game, if a player receives the "double blank" or 0-0 value domino to start the game and is then able to reach the four (4) dominos played level, then the player is provided the opportunity to play the bonus event. As indicated above, the bonus event might be triggered by a variety of other events, and might be played as an independent game or as a qualifier to a game. Preferably, a player is permitted to play the bonus event without placing an additional wager, though in other embodiments, a player might be required to place a wager to play the event.

It is noted that this bonus event could be played in either a table or video format. The event could vary, such as by having different numbers of dominos. For example, the dice which are utilized to play the game could have more than six sides, such as well-known twelve-sided dice. In that event, the dominos might have values from 1-12. When playing a video version of the game, video-simulated dice may be displayed. It is also possible to play the event with other than dice. For example, a board could display the numbers 1-6 and one of those numbers might be randomly selected to generate the values which the player attempts to match against the displayed dominos.

A particular advantage of this bonus event is that, as indicated, it can offer a high payout owing to the low probability of matching all of the dominos before three misses are received. The odds might vary, however, such as by changing the number of misses that the player can receive. For example, if a player is only allowed two misses, then the odds of matching all of the dominos is much lower, while if the player is allowed four or more misses, the odds of matching all of the dominos is much higher.

In one embodiment, both bonus events may be implemented as part of the game. Thus, a player may have the opportunity to play the "matching" bonus event for additional winnings, and still be provided one or more opportunities to play the "double-up" bonus event described above.

As one aspect of a game of the invention, losing outcomes of the game may provide the opportunity to be winning outcomes. In one embodiment, if a player is unable to play enough dominos to reach a winning level (either by number of dominos played, point value or otherwise), the player may be provided the opportunity for winnings.

In one embodiment, in the event of a losing main game outcome (where the player did not reach any winning level) the player may be awarded a ticket or other entry into a drawing, such as a lottery or similar event, for the opportunity to be awarded winnings. The player might also be provided the opportunity to randomly win an award. For example, a portion of each wager may be set aside into a pool. Each player who receives a losing outcome during a period of time may compete for the pool (such as in a random drawing) or the pool (or a portion thereof) might randomly be awarded to a player when they receive a losing outcome.

As indicated above, the game may be configured so that dominos are selected and played automatically, or by player selection. In a gaming machine environment, the domino selection may be machine automated. In one embodiment of the game, the base game portion may be played in an "auto-play" mode. In this mode, the dominos are selected and played by the machine without player input or with only limited player input. This configuration of the game has the advantage that play speed is increased, shortening the time of game play. In a preferred embodiment, the bonus games or events remain player input games (such as by permitting the player to select the player and dealer dominos in the comparison bonus event). In this manner, bonus events are played more slowly, generating high level of player excitement. Of course, variety of combinations of automation and/or player input may be utilized.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A method of playing a domino game comprising:

accepting a wager;

displaying a first domino;

selecting a second domino;

determining if said second domino matches said first domino and, if so, playing said domino and, if not, placing said second domino in a later play position;

and continuing play by:

(a) selecting an additional domino;

(b) determining if said additional domino is playable and if so, playing said domino and then playing as many dominos as possible from said later play position, and if not, placing said additional domino in said later play position; and (c) repeating steps (a) and (b) until either all dominos available for play are played or a predetermined number of dominos are placed in said later play position; and awarding winnings based upon a number of dominos played or a total value of dominos played.

2. The method in accordance with claim 1 including the step of providing a set of dominos for play.

3. The method in accordance with claim 1 wherein said game is presented at an electronically controlled gaming machine.

4. The method in accordance with claim 1 wherein said step of displaying comprises generating a graphical representation of said first domino.

5. The method in accordance with claim 1 including the step of displaying said second domino and each additional selected domino.

6. The method in accordance with claim 1 including the step of selecting said first domino from a set of dominos displayed face-down.

7. The method in accordance with claim 6 including the step of displaying all unselected dominos from said set after step (c).

8. The method in accordance with claim 1 including offering a bonus event once at least one predetermined number of dominos are played.

9. The method in accordance with claim 8 wherein said event comprises selecting a dealer domino and a player domino from a domino set and comparing a value of said player domino to a value of said dealer domino.

10. The method in accordance with claim 9 wherein an outcome of said bonus event is declared a winning outcome if said value of said player domino exceeds said value of said dealer domino.

11. The method in accordance with claim 1 including the step of providing a paytable which defines two or more numbers of dominos which, if played, have associated winnings.

12. The method in accordance with claim 1 including the step of initiating a bonus game if a triggering event is received, said bonus game comprising displaying a plurality of dominos, obtaining pairs of values from a pair of dice, eliminating dominos having values which match the pairs of values, and stopping the bonus event once a predetermined number of pairs of values from said pair of dice do not match said dominos.

* * * * *